US011180863B2

(12) United States Patent
Jiao et al.

(10) Patent No.: US 11,180,863 B2
(45) Date of Patent: Nov. 23, 2021

(54) DEVICE AND METHOD FOR PREPARING PURE TITANIUM BY ELECTROLYSIS-CHLORINATION-ELECTROLYSIS

(71) Applicants: University of Science and Technology Beijing, Beijing (CN); Beijing Institute of Technology, Beijing (CN)

(72) Inventors: Shuqiang Jiao, Beijing (CN); Zhe Wang, Beijing (CN); Handong Jiao, Beijing (CN)

(73) Assignees: UNIVERSITY OF SCIENCE AND TECHNOLOGY BEIJING, Beijing (CN); BEIJING INSTITUTE OF TECHNOLOGY, Beijing (CN)

( * ) Notice: Subject to any disclaimer, the term of this patent is extended or adjusted under 35 U.S.C. 154(b) by 106 days.

(21) Appl. No.: 16/612,739

(22) PCT Filed: Mar. 27, 2019

(86) PCT No.: PCT/CN2019/079833
§ 371 (c)(1),
(2) Date: Nov. 11, 2019

(87) PCT Pub. No.: WO2020/103366
PCT Pub. Date: May 28, 2020

(65) Prior Publication Data

US 2021/0025065 A1 Jan. 28, 2021

(30) Foreign Application Priority Data

Nov. 23, 2018 (CN) ..... 201811408695.1
Nov. 23, 2018 (CN) ..... 201821942940.2

(51) Int. Cl.
*C25C 3/26* (2006.01)
*C25C 3/28* (2006.01)
(Continued)

(52) U.S. Cl.
CPC ..... *C25C 3/28* (2013.01); *C25C 7/005* (2013.01); *C25C 7/025* (2013.01)

(58) Field of Classification Search
CPC .. C25C 3/28; C25C 7/025; C25C 3/26; C25C 3/12; C25C 7/005; C25C 7/06; C25C 3/00; C25C 7/02; C25C 5/04
See application file for complete search history.

(56) References Cited

U.S. PATENT DOCUMENTS

2016/0215407 A1 7/2016 Iosaki et al.
2016/0222533 A1* 8/2016 Zhu ..... C25C 3/28

FOREIGN PATENT DOCUMENTS

CN 1712571 A 12/2005
CN 103290433 A 9/2013
(Continued)

*Primary Examiner* — Zulmariam Mendez
(74) *Attorney, Agent, or Firm* — Bayramoglu Law Offices LLC

(57) ABSTRACT

A device and a method for preparing pure titanium by electrolysis-chlorination-electrolysis, wherein the device includes a first electrolytic cell, a second electrolytic cell, a chlorination reactor and guide tubes. The $Cl_2$ generated at the anode of the first electrolytic cell is introduced into a chlorination reactor containing the $TiC_xO_y$ or $TiC_xO_yN_z$ raw materials via a guide tube, and a chlorination is carried out to generate $TiCl_4$ gas at a temperature of 200° C.-600° C. The $TiCl_4$ gas passes through a guide tube into a cathode of the second electrolytic cell, and then an electrolysis is performed to obtain the high-purity titanium in the second electrolytic cell. At the same time, the $Cl_2$ generated at the anode of the second electrolytic cell is recycled into the chlorination reactor in the first electrolytic cell to continue to participate in the chlorination of $TiC_xO_y$ or $TiC_xO_yN_z$.

8 Claims, 1 Drawing Sheet

(51) Int. Cl.
*C25C 7/00* (2006.01)
*C25C 7/02* (2006.01)

(56) References Cited

FOREIGN PATENT DOCUMENTS

| | | | |
|---|---|---|---|
| CN | 103451682 | A | 12/2013 |
| CN | 103774180 | A | 5/2014 |
| CN | 107164781 | A | 9/2017 |
| CN | 109267100 | A | 1/2019 |
| JP | 2015218337 | A | 12/2015 |

* cited by examiner

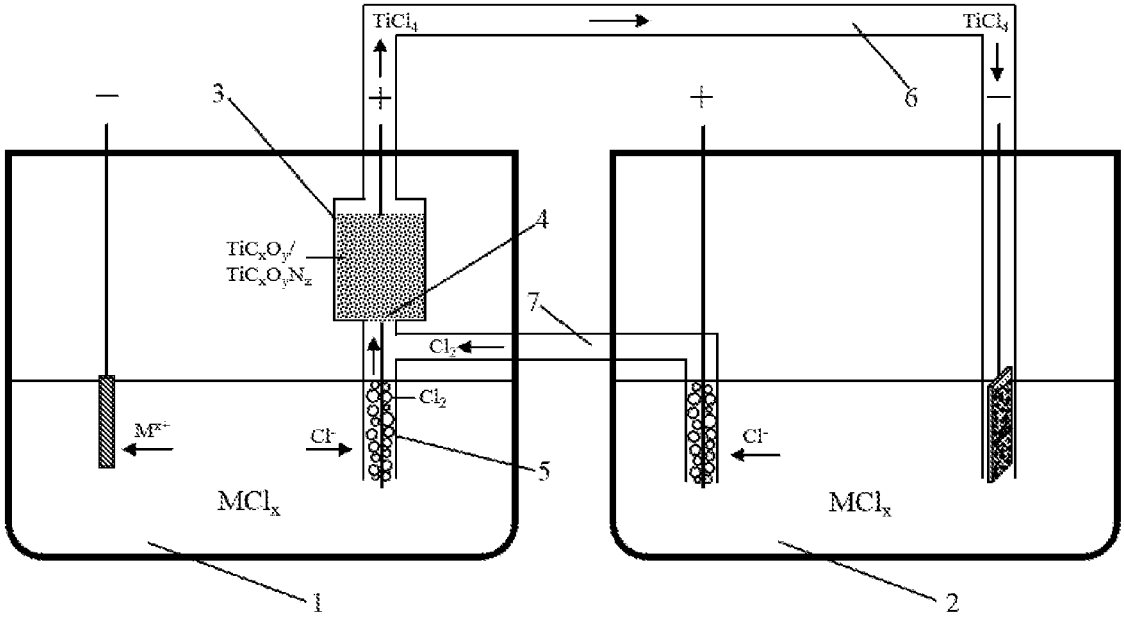
TiCl4
TiCl4
3
6
4
TiCxOy/
TiCxOyNz
7
Cl2
Cl2
Mx+
Cl-
Cl-
5
MClx
MClx
1
2

DEVICE AND METHOD FOR PREPARING PURE TITANIUM BY ELECTROLYSIS-CHLORINATION-ELECTROLYSIS

CROSS REFERENCE TO THE RELATED APPLICATIONS

This application is the national phase entry of International Application No. PCT/CN2019/079833, filed on Mar. 27, 2019, which is based upon and claims priority to Chinese Patent Applications No. 201811408695.1 and No. 201821942940.2, both filed on Nov. 23, 2018, the entire contents of which are incorporated herein by reference.

TECHNICAL FIELD

The present disclosure relates to a device and a method for preparing pure titanium by electrolysis-chlorination-electrolysis, and belongs to the field of the production of titanium by electrolysis.

BACKGROUND

Titanium has many excellent physical and chemical properties, such as having low density (4.5 g/cm$^3$), high melting point (1660° C.), corrosion resistance, oxidation resistance, being non-toxic and harmless, and having good biocompatibility. Because of these properties, Titanium is called the "future metal". Titanium has a wide range of applications in aerospace, chemistry and chemical engineering, ships and warships, biological medicine, civil building materials, sports equipment and other fields. In this regard, titanium having a titanium content higher than 99.95% or 99.99% (i.e., 3N5 or 4N) is called a high-purity titanium. The high-purity titanium has the excellent properties compared to ordinary titanium, and furthermore has the excellent percentage elongation (50-60%) and percentage reduction in area (70-80%) and an ultra-low level of harmful impurity elements over an ordinary titanium. Therefore, the high-purity titanium is favored in high-end applications such as high-end microelectronics, cutting-edge aerospace technologies, very large-scale precise integrated circuits and display screens.

At present, there are two main methods for industrial production of the high-purity titanium, one is the Kroll method and the other is the molten salt electrolysis. In the Kroll method, $TiO_2$ is mixed with carbon and chlorinated to obtain $TiCl_4$, and $TiCl_4$ is then subjected to a thermal reduction by magnesium to obtain titanium, while the byproduct $MgCl_2$ has to be decomposed by molten salt electrolysis for recycling. The whole process takes long time and the yield is limited. In addition, in order to obtain the high-purity titanium, the raw materials ($TiCl_4$ and magnesium) tend to require higher purity, thereby increasing the preparation cost of the high-purity titanium. In the molten salt electrolysis, a sponge titanium is used as an anode, a titanium-containing halide molten salt is used as an electrolyte. During an electrolysis process, the sponge titanium is dissolved at the anode, and a titanium ion is deposited at the cathode, thereby obtaining the high-purity titanium. Compared with the Kroll method, the molten salt electrolysis is simple, and can effectively control the oxygen content in the product to obtain a high-purity titanium having low oxygen content. However, the titanium sponge has to be prepared by the Kroll method, so the upstream process of the molten salt electrolysis is complicated and inefficient, which ultimately leads to a high cost of electrolysis and refining of molten salt with the sponge titanium as the anode.

In order to solve the above problems, the present invention provides a device and a method for preparing pure titanium by electrolysis-chlorination-electrolysis. Titanium dioxide and carbonaceous material powder are mixed in a certain ratio, briquetted, and then subjected to a carbothermic reduction to obtain $TiC_xO_y$ or $TiC_xO_yN_z$ as a raw material. In a first electrolytic cell, a molten alkali chloride, a molten alkaline earth chloride, molten aluminum chloride or their mixture are electrolyzed. The chlorine gas obtained at the anode of the first electrolytic cell is introduced into a chlorination reactor containing the $TiC_xO_y$ or $TiC_xO_yN_z$ raw material, thereby initiating a chlorination to obtain $TiCl_4$ gas. The $TiCl_4$ gas passes through a guide tube into a cathode of a second electrolytic cell, and then an electrolysis occurs to generate the high-purity titanium by taking advantage of the solubility of $TiCl_4$ in the second electrolytic cell. At the same time, $Cl_2$ generated at the anode of the second electrolytic cell is recycled into the chlorination reactor in the first electrolytic cell to continue to participate in the chlorination of $TiC_xO_y$ or $TiC_xO_yN_z$. Compared with the Kroll method or the conventional molten salt electrolysis for preparing the high-purity titanium, the device and the method for preparing pure titanium by electrolysis-chlorination-electrolysis avoids the tedious and complicated batch production characteristic of the Kroll method from the source, simplifies the entire process flow, and reduces the production cost of preparing high-purity titanium by the Kroll method or the conventional molten salt electrolysis. In addition, components of the molten salt in the first electrolytic cell can be selected depending on the market changes or customers' requirements on alkali metal, alkaline earth, aluminum or alloy, thus increasing the usability and value of the byproducts.

SUMMARY

The present invention provides a device and a method for preparing pure titanium by electrolysis-chlorination-electrolysis. Compared with the Kroll method or the molten salt electrolysis with a sponge titanium as a raw material for preparing the high-purity titanium, the method of the present disclosure has the advantages of simple process and low cost, and can produce highly valuable byproducts.

FIGURE is a schematic view of a device for preparing pure titanium by electrolytic-chlorination-electrolysis according to the present disclosure. The device includes a first electrolytic cell, a second electrolytic cell, a chlorination reactor and guide tubes. The characteristics of the device are as follows.

The first electrolytic cell and the second electrolytic cell are horizontally disposed. A heating and temperature controlling system is provided at the bottom and the periphery of the first electrolytic cell and the second electrolytic cell to control the temperature of the electrolyte in the two electrolytic cells.

The chlorination reactor is located at an upper position of the anode of the first electrolytic cell, and a porous ceramic partition plate is disposed at the bottom of the chlorination reactor. The shell of the chlorination reactor is made of steel and is lined with a ceramic material. An independent heating and temperature controlling system is arranged outside the chlorination reactor to control the temperature of materials inside the chlorination reactor.

A first guide tube is located at a position of the anode in the first electrolytic cell and is connected to the bottom of the chlorination reactor. One end of a second guide tube is connected to the top of the chlorination reactor, and the other end is located at the position of the cathode in the second electrolytic cell. One end of a third guide tube is located at a position of the anode in the second electrolytic cell, and the other end is connected to the first guide tube in the first electrolytic cell. The guide tubes are made of steel and are lined with ceramic or polytetrafluoroethylene.

A method for preparing pure titanium by electrolysis-chlorination-electrolysis using the device of the present disclosure includes the following steps:

1) uniformly mixing titanium dioxide and carbonaceous material powder according to a stoichiometric ratio and performing a press molding, in a temperature range of 900° C. to 1600° C., preparing $TiC_xO_y$ in vacuum or $TiC_xO_yN_z$ in a nitrogen atmosphere to introduce into a chlorination reactor;

2) in a first electrolytic cell, using a molten alkali metal chloride, a molten alkaline earth metal chloride, molten aluminum chloride or a mixture thereof as a supporting electrolyte, using a carbon material as an anode and a metal material as a cathode, controlling the temperature of the first electrolytic cell at 150° C. to 1000° C., and controlling the temperature of the chlorination reactor at 200° C. to 600° C.; wherein after an electrolysis starts, $Cl^-$ migrates to the anode and reacts to produce $Cl_2^-$; the product $Cl_2$ at the anode passes through the porous partition plate, enters the chlorination reactor via the first guide tube and reacts with $TiC_xO_y$ or $TiC_xO_yN_z$ in the chlorination reactor to produce $TiCl_4$ gas; the $TiCl_4$ gas enters the cathode region of the second electrolytic cell via the second guide tube;

3) in a second electrolytic cell, using a molten alkali metal chloride, a molten alkaline earth metal chloride or a mixture thereof as a supporting electrolyte, using a carbon material as an anode and a metal material as a cathode, and controlling the temperature of the second electrolytic cell at 500° C. to 1000° C.; wherein after the electrolysis starts, the $TiCl_4$ gas transported by the second guide tube enters the molten salt at a position of the cathode of the second electrolytic cell, $Ti^{4+}$ reacts at the cathode to generate low-valent titanium ions, and the low-valent titanium ions continue to react for deposition to obtain pure titanium at the cathode, and the reaction is as follows:

$$Ti^{4+}+e=Ti^{3+}$$

$$Ti^{3+}+e=Ti^{2+}$$

$$Ti^{2+}+2e=Ti$$

$Cl^-$ migrates to the anode of the second electrolytic cell and generates $Cl_2$ at the anode; then, the $Cl_2$ is transported into the first guide tube via a third guide tube, and is mixed with the $Cl_2$ generated at the anode of the first electrolytic cell to enter the chlorination reactor to participate in the chlorination of $TiC_xO_y$ or $TiC_xO_yN_z$;

4) after the end of one electrolysis cycle, taking products at the cathodes of the two electrolytic cells, and performing pickling, washing, and drying; wherein the product collected from the cathode of the second electrolytic cell is high-purity titanium, and the product collected from the cathode of the first electrolytic cell is byproducts including alkali metal, alkaline earth metal, aluminum or alloy;

5) after completing the step 4), mounting the cathodes into the two electrolytic cells, and putting new $TiC_xO_y$ or $TiC_xO_yN_z$ raw material into the chlorination reactor for a new round of operation to produce the high-purity titanium by electrolysis.

In the step 1), the carbonaceous material powder is one or a combination of graphite, petroleum coke, carbon black, coal, and charcoal.

In the step 1), the ratio of a number of oxygen atoms in the titanium dioxide to a number of carbon atoms in the carbon material powder is 1.2:1-0.5:1, preferably 1:1-0.667:1.

In the step 2) and the step 3), the metal materials of the cathodes in the first electrolytic cell and the second electrolytic cell are titanium, carbon steel or nickel.

In the step 2) and the step 3), during the electrolysis, current densities in the first electrolytic cell and the second electrolytic cell are: 0.01 A/cm$^2$ to 2.00 A/cm$^2$ at the anodes, and 0.01 A/cm$^2$ to 2.00 A/cm$^2$ at the cathodes.

Compared with the prior art, the present invention has the following advantages.

1) The chlorine gas preparation, the low-temperature chlorination of titanium oxycarbide or titanium oxycarbonitride and the electrolysis of titanium tetrachloride are completed in the same device, and the process is simple, clean and efficient.

2) The processes of thermal reduction using magnesium and electrolytic decomposition of $MgCl_2$ in the Kroll method are avoided, thereby greatly shortening the preparation process of the high-purity titanium.

3) The application of the two electrolytic cells separates the low-temperature chlorination of titanium oxycarbide or titanium oxycarbonitride from the electrolytic reduction of $TiCl_4$, which is beneficial to the preparation of the high-purity titanium, ensuring the purity of titanium. Moreover, the $Cl_2$ generated at the two anodes are recycled, further reducing pollution and energy consumption.

4) The byproducts obtained in the first electrolytic cell can be precisely customized depending on the market changes or customer needs, so as to improve the utilization value of the byproducts.

BRIEF DESCRIPTION OF THE DRAWINGS

FIGURE is a schematic diagram of a device for preparing pure titanium by electrolysis-chlorination-electrolysis according to the present disclosure.

In the FIGURE: 1. first electrolytic cell, 2. second electrolytic cell, 3. chlorination reactor, 4. porous ceramic partition plate, 5. first guide tube, 6. second guide tube, 7. third guide tube.

DETAILED DESCRIPTION OF THE EMBODIMENTS

Embodiment 1

Titanium dioxide and graphite powder are uniformly mixed at a mass ratio of 40:12, and then press-molded and sintered for 3 hours at 1400° C. in vacuum to obtain $TiC_{0.5}O_{0.5}$. The $TiC_{0.5}O_{0.5}$ is put into a chlorination reactor. The first electrolytic cell uses a NaCl—$AlCl_3$ eutectic salt as an electrolyte, and the second electrolytic cell uses a NaCl—KCl eutectic salt as an electrolyte. The two electrolytic cells are protected by inert gas. During the electrolysis, in the first electrolytic cell, the temperature is controlled at 150° C., and both the cathode and the anode are made of graphite, the current density at the cathode is 0.5 A/cm$^2$ and the current density at the anode is 1 A/cm$^2$; in the second electrolytic cell, the temperature is controlled at 750° C., the anode is made of graphite, the cathode is made of a nickel plate, the current density at the cathode is 1 A/cm$^2$ and the current density at the anode is 2 A/cm$^2$. After the end of one electrolysis cycle, high-purity titanium is collected from the cathode, made of the nickel plate, of the second electrolytic cell, and the high-purity titanium is processed by pickling, washing, drying, and encapsulation to obtain the powder or crystal of the high-purity titanium. The aluminum is collected from the cathode of the first electrolytic cell.

Embodiment 2

Titanium dioxide and graphite powder are uniformly mixed at a mass ratio of 40:15, and then press-molded and sintered for 2 hours at 1600° C. in vacuum to obtain $TiC_{0.25}O_{0.75}$. The $TiC_{0.25}O_{0.75}$ is put into a chlorination reactor. The first electrolytic cell uses a NaCl—$MgCl_2$—$AlCl_3$ eutectic salt as an electrolyte, and the second electrolytic cell uses a NaCl—LiCl—KCl eutectic salt as an electrolyte. The two electrolytic cells are protected by inert gas. During the electrolysis, in the first electrolytic cell, the temperature is controlled at 550° C., and both the cathode and the anode are made of graphite, the current density at the cathode is 0.5 A/cm$^2$ and the current density at the anode is 1.5 A/cm$^2$; in the second electrolytic cell, the temperature is controlled at 600° C., the anode is made of graphite, the cathode is made of a titanium plate, the current density at the cathode is 0.5 A/cm$^2$ and the current density at the anode is 1 A/cm$^2$. After the end of one electrolysis cycle, high-purity titanium is collected from the cathode, made of the titanium plate, of the second electrolytic cell, and the high-purity titanium is processed by pickling, washing, drying, and encapsulation to obtain the powder or crystal of the high-purity titanium. The magnesium-aluminum alloy is collected from the cathode of the first electrolytic cell.

Embodiment 3

Titanium dioxide and graphite powder are uniformly mixed at a mass ratio of 40:12, and then press-molded and sintered for 3 hours at 1300° C. in a nitrogen atmosphere to obtain $TiC_{0.2}O_{0.2}N_{0.6}$. The $TiC_{0.2}O_{0.2}N_{0.6}$ is put into a chlorination reactor. The first electrolytic cell uses a LiCl—KCl eutectic salt as an electrolyte, and the second electrolytic cell uses a NaCl—CaCl eutectic salt as an electrolyte. The two electrolytic cells are protected by inert gas. During the electrolysis, in the first electrolytic cell, the temperature is controlled at 750° C., and both the cathode and the anode are made of graphite, the current density at the cathode is 0.2 A/cm$^2$ and the current density at the anode is 1.5 A/cm$^2$; in the second electrolytic cell, the temperature is controlled at 800° C., the anode is made of graphite, the cathode is made of a nickel plate, the current density at the cathode is 0.5 A/cm$^2$ and the current density at the anode is 1.5 A/cm$^2$. After the end of one electrolysis cycle, high-purity titanium is collected from the cathode, made of the nickel plate, of the second electrolytic cell, and the high-purity titanium is processed by pickling, washing, drying, and encapsulation to obtain the powder or crystal of the high-purity titanium. The potassium is collected from the cathode of the first electrolytic cell.

Of course, the present invention may have many different embodiments, and various changes and modifications can be made to the present disclosure by those skilled in the art without deviating from the technical essence of the present disclosure. Such corresponding changes and modifications shall fall within the protection scope of the claims of the present invention.

What is claimed is:

1. A device for preparing pure titanium by electrolysis-chlorination-electrolysis, comprising a first electrolytic cell, a second electrolytic cell, a chlorination reactor and a plurality of guide tubes; wherein the chlorination reactor is configured to contain $TiC_xO_y$;

wherein, the first electrolytic cell and the second electrolytic cell are horizontally disposed; a first heating and temperature controlling system is provided at a bottom and a periphery of the first electrolytic cell and a bottom and a periphery of the second electrolytic cell to control a temperature of an electrolyte in the first electrolytic cell and the second electrolytic cell; the chlorination reactor is located at an upper position of an anode of the first electrolytic cell, and a porous ceramic partition plate is disposed at a bottom of the chlorination reactor;

a shell of the chlorination reactor is made of steel, and the chlorination reactor is lined with a ceramic material; a second heating and temperature controlling system is arranged outside the chlorination reactor to control a temperature of materials inside the chlorination reactor;

a first guide tube of the plurality of guide tubes is located at a position of the anode in the first electrolytic cell and is connected to the bottom of the chlorination reactor; a first end of a second guide tube of the plurality of guide tubes is connected to a top of the chlorination reactor, and a second end of the second guide tube is located at a position of a cathode in the second electrolytic cell; a first end of a third guide tube of the plurality of guide tubes is located at a position of an anode in the second electrolytic cell, and a second end of the third guide tube is connected to the first guide tube in the first electrolytic cell; the plurality of guide tubes are made of steel and are lined with ceramic or polytetrafluoroethylene.

2. A method for preparing pure titanium by means of a device for preparing pure titanium by electrolysis-chlorination-electrolysis, the device comprising a first electrolytic cell, a second electrolytic cell, a chlorination reactor and a plurality of guide tubes;

wherein the chlorination reactor is configured to contain $TiC_xO_y$;

wherein, the first electrolytic cell and the second electrolytic cell are horizontally disposed; a first heating and temperature controlling system is provided at a bottom and a periphery of the first electrolytic cell and a bottom and a periphery of the second electrolytic cell to control a temperature of an electrolyte in the first electrolytic cell and the second electrolytic cell; the chlorination reactor is located at an upper position of an anode of the first electrolytic cell, and a porous ceramic partition plate is disposed at a bottom of the chlorination reactor;

a shell of the chlorination reactor is made of steel, and the chlorination reactor is lined with a ceramic material; a second heating and temperature controlling system is arranged outside the chlorination reactor to control a temperature of materials inside the chlorination reactor;

a first guide tube of the plurality of guide tubes is located at a position of the anode in the first electrolytic cell and is connected to the bottom of the chlorination reactor; a first end of a second guide tube of the plurality of guide tubes is connected to a top of the chlorination reactor, and a second end of the second guide tube is located at a position of a cathode in the second electrolytic cell; a first end of a third guide tube of the plurality of guide tubes is located at a position of an anode in the second electrolytic cell, and a second end of the third guide tube is connected to the first guide tube in the first electrolytic cell; the plurality of guide tubes are made of steel and are lined with ceramic or polytetrafluoroethylene the method comprising:

1) uniformly mixing titanium dioxide and carbonaceous material powder according to a stoichiometric ratio to obtain a mixture and performing a press molding on the mixture, in a temperature range of 900° C. to 1600° C., preparing $TiC_xO_y$ in vacuum to introduce into the chlorination reactor;

2) in the first electrolytic cell, using a molten alkali metal chloride, a molten alkaline earth metal chloride, molten aluminum chloride or a mixture of the molten alkali metal chloride, the molten alkaline earth metal chloride and the molten aluminum chloride as a supporting electrolyte, using a carbon material as an anode and a metal material as a cathode, controlling a temperature of the first electrolytic cell at 150° C. to 1000° C., and controlling a temperature of the chlorination reactor at 200° C. to 600° C.; wherein after an electrolysis starts, $Cl^-$ migrates to the anode and reacts to produce $Cl_2$; the $Cl_2$ at the anode passes through a porous partition plate and enters the chlorination reactor via the first guide tube and reacts with $TiC_xO_y$ in the chlorination reactor to produce $TiCl_4$ gas; the $TiCl_4$ gas enters the cathode of the second electrolytic cell via the second guide tube;

3) in the second electrolytic cell, using a molten alkali metal chloride, a molten alkaline earth metal chloride or a mixture of the molten alkali metal chloride and the molten alkaline earth metal chloride as a supporting electrolyte, using a carbon material as an anode and a metal material as a cathode, and controlling a temperature of the second electrolytic cell at 500° C. to 1000° C.; wherein after an electrolysis starts, the $TiCl_4$ gas transported by the second guide tube enters the supporting electrolyte at a position of the cathode of the second electrolytic cell, $Ti^{4+}$ reacts at the cathode to generate low-valent titanium ions, and the low-valent titanium ions continue to react for deposition to obtain pure titanium at the cathode, and the reaction is as follows:

$$Ti^{4+}+e=Ti^{3+}$$

$$Ti^{3+}+e=Ti^{2+}$$

$$Ti^{2+}+2e=Ti$$

$Cl^-$ migrates to an anode of the second electrolytic cell and generates $Cl_2$ at the anode of the second electrolytic cell; then, the $Cl_2$ is transported into the first guide tube via the third guide tube, and is mixed with the $Cl_2$ generated at the anode of the first electrolytic cell to enter the chlorination reactor to participate in a chlorination of $TiC_xO_y$;

4) after an end of one electrolysis cycle, taking a first product at the cathode of the first electrolytic cell and a second product at the cathode of the second electrolytic cell, and performing pickling, washing, and drying on the first product and the second product; wherein the second product is high-purity titanium, and the first product is byproducts including alkali metal, alkaline earth metal, aluminum or alloy;

5) after completing the step 4), mounting the cathode of the first electrolytic cell into the first electrolytic cell and mounting the cathode of the second electrolytic cell into the second electrolytic cell, and putting new $TiC_xO_y$ raw material into the chlorination reactor for a new round of operation to produce the high-purity titanium by electrolysis.

3. The method for preparing the pure titanium according to claim 2, wherein, the carbonaceous material powder is one or a combination of graphite, petroleum coke, carbon black, coal, and charcoal.

4. The method for preparing the pure titanium according to claim 2, wherein, a ratio of a number of oxygen atoms in the titanium dioxide to a number of carbon atoms in the carbon material powder is 1.2:1-0.5:1.

5. The method for preparing the pure titanium according to claim 2, wherein, a ratio of a number of oxygen atoms in the titanium dioxide to a number of carbon atoms in the carbon material powder is 1:1-0.667:1.

6. The method for preparing the pure titanium according to claim 2, wherein, the metal material for the cathode in the first electrolytic cell and the metal material for the cathode in the second electrolytic cell are titanium, carbon steel or nickel.

7. The method for preparing the pure titanium according to claim 2, wherein, during the electrolysis in the first electrolytic cell, current densities are 0.01 $A/cm^2$ to 2.00 $A/cm^2$ at the anode and 0.01 $A/cm^2$ to 2.00 $A/cm^2$ at the cathode; and during the electrolysis in the second electrolytic cell, current densities are 0.01 $A/cm^2$ to 2.00 $A/cm^2$ at the anode and 0.01 $A/cm^2$ to 2.00 $A/cm^2$ at the cathode.

8. The method for preparing the pure titanium according to claim 4, wherein, the ratio is 1:1-0.667:1.

* * * * *